United States Patent [19]

Henmi et al.

[11] Patent Number: 4,477,795

[45] Date of Patent: Oct. 16, 1984

[54] ROTARY ELECTRIC COMPONENT

[75] Inventors: Shoichi Henmi; Junichi Imura; Isao Moriya, all of Miyagi, Japan

[73] Assignee: Alps Electric Co., Ltd., Tokyo, Japan

[21] Appl. No.: 431,385

[22] Filed: Sep. 30, 1982

[30] Foreign Application Priority Data

Feb. 16, 1982 [JP] Japan ..... 56-20460[U]

[51] Int. Cl.[3] ..... H01C 10/32

[52] U.S. Cl. ..... 338/163; 338/174; 338/164; 338/199

[58] Field of Search ..... 338/162, 163, 164, 184, 338/199, 174, 188

[56] References Cited

U.S. PATENT DOCUMENTS

| | | | |
|---|---|---|---|
| 1,672,123 | 6/1928 | Hartranft | 338/163 X |
| 2,894,238 | 7/1959 | Burden | 338/174 |
| 3,200,359 | 8/1965 | Hulbert | 338/163 X |
| 3,639,877 | 2/1972 | Fresard et al. | 338/163 X |
| 4,329,676 | 5/1982 | McDonald et al. | 338/163 X |

FOREIGN PATENT DOCUMENTS

| | | | |
|---|---|---|---|
| 2205416 | 8/1973 | Fed. Rep. of Germany | 338/162 |

*Primary Examiner*—C. L. Albritton

*Attorney, Agent, or Firm*—Guy W. Shoup; Gerard F. Dunne

[57] ABSTRACT

A rotary electric component such as a semifixed variable resistor comprises an insulating substrate having a shaft hole, a resistor mounted on the insulating substrate surrounding the shaft hole, a pair of electrodes mounted on the insulating substrate and connected to the resistor at ends thereof, a pair of terminals mounted on the insulating substrate and connected to the electrodes, respectively, a shaft rotatably mounted in the shaft hole and having a movable contact held in sliding contact with the resistor, a cover mounted on the shaft over the insulating substrate and covering the movable contact, the cover having a skirt spaced from the insulating substrate by a gap, and a body of synthetic resin mounted on the insulating substrate and a portion formed as a dust wall covering the gap.

6 Claims, 8 Drawing Figures

ROTARY ELECTRIC COMPONENT

BACKGROUND OF THE INVENTION

The present invention relates to a rotary electric component such as a semifixed variable resistor or a rotary switch.

Conventional semifixed variable resistors often include an insulating substrate and a cover mounted on a rotatable shaft. The cover typically has a skirt spaced apart from the insulating substrate by a gap. Dust or soldering flux tends to find its way through the gap into the cover and cause malfunctions of the semifixed variable resistor.

SUMMARY OF THE INVENTION

It is an object of the present invention to provide a rotary electric component which has a simple construction for preventing dust from entering through a gap between a cover and an insulating substrate.

According to the present invention, a molded body of synthetic resin is mounted on an insulating substrate by outsert molding and has a portion formed as a dust wall covering a gap between a cover and the insulating substrate.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
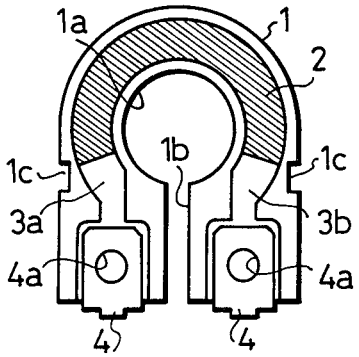
Fig.1 PRIOR ART
FIG. 1 is a front elevational view of an insulating substrate in a conventional semifixed variable resistor.
Figure 2:
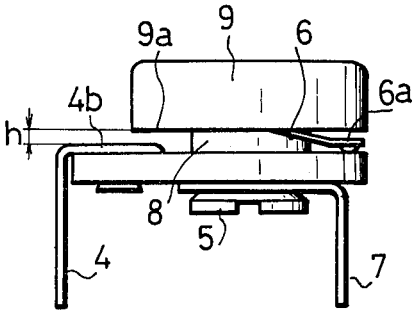
Fig.2 PRIOR ART
FIG. 2 is a side elevational view of a conventional semifixed variable resistor.

FIGS. 1 and 2 show a conventional semifixed variable resistor. The semifixed variable resistor has an insulating substrate 1 made of a laminated sheet of phenolic resin or the like. The insulating substrate 1 has a central shaft hole 1*a* and a semicircular resistor 2 deposited on a surface thereof concentrically around the shaft hole 1*a*, the resistor 2 being formed of carbon or the like printed on the insulating substrate 1. The resistor 2 has on ends thereof a pair of electrodes 3*a*, 3*b* of such conductive material as silver deposited on the insulating substrate 1 by printing or evaporation. A pair of grommets 4*a* are fixed respectively to ends of the electrodes 3*a*, 3*b* by grommets 4*a*, 4*a* staked around attachment holes defined in the insulating substrate 1. The insulating substrate 1 has a slot 1*b* located centrally between the electrodes 3*a*, 3*b* and extending contiguously to the shaft hole 1*a*. The slot 1*b* serves to prevent migration of silver which would be caused when the electrodes 3*a*, 3*b* are deposited, thereby avoiding shortcircuiting between the electrodes 3*a*, 3*b*.

For assembling the semifixed variable resistor, a shaft 5 is rotatably mounted in the shaft hole 1*b*, as shown in FIG. 2. Then, a movable contact 6 is attached to an upper portion of the shaft 5, and a terminal 7 is attached to the reverse side of the insulating substrate 1 in electric connection to the shaft 5. A support spacer 8 of synthetic resin is fitted around the shaft 5 between the movable contact 6 and the insulating substrate 1 for supporting the shaft 5 in position. A cap-shaped cover 9 is fixted to the upper end of the shaft 5, the cover 9 being made of an insulating material such as synthetic resin and doubling as a control knob for rotating the shaft 5. When the semifixed variable resistor is to be actuated, the shaft 5 and the movable contact 6 are rotated by operating the cover 9 to cause a distal end of the movable contact 6 to slide on the resistor 2. When the movable contact 6 is stopped at a desired position, a resistance is established between the terminal 7 electrically connected to the movable contact 6 and either one of the terminals 4.

With the conventional construction, an effort has been made to render the electric component smaller in overall size by locating an attachment end 4*b* of the terminal 4 closely to the shaft 5 and hence immediately below a skirt 9*a* of the cover 9, resulting in the necessity of providing a gap h between the skirt 9*a* of the cover 9 and the attachment end 4*b* of the terminal 4*b*. With the gap h, however, the skirt 9*a* of the cover 9 and the upper surface of the insulating substrate 1 must be spaced apart from each other by a greater gap H. The gap H tends to allow dust and soldering flux to enter the cover 9, a condition which leads to failure of the electric component. Furthermore, the known semifixed variable resistor is also disadvantageous in that the slot 1*b* reduces the mechanical strength of the insulating substrate 1, which is liable to get damaged under external forces. A conventional solution to this problem has been a collector integral with the terminal 7 and having grip fingers engaging in grooves 1*c* defined in opposite edges of the insulating substrate 1 to reinforce the latter.

FIGS. 3(A) through 3(C) and 4 show an insulating substrate according to an embodiment of the present invention.

The insulating substrate, designated by the reference character 1, is in the form of a laminated sheet of phenolic resin, and has a shape substantially as shown in FIG. 1. More specifically, the insulating substrate 1 has a central shaft hole 1*a* and a slot 1*b* extending contiguously to the central shaft hole 1*a* and serving to prevent shortcircuiting between electrodes 3*a*, 3*b*. A resistor 2 of carbon is deposited on the insulating substrate 1. The electrodes 3*a*, 3*b* are made of silver and deposited on the insulating substance 1 and connected respectively to ends of the resistor 2. Terminals 4 are fixed by grommets 4*a*, 4*b* and connected respectively to ends of the electrodes 3*a*, 3*b*.

Figure 3A:
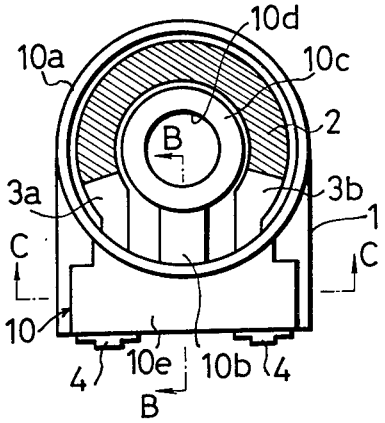
FIG. 3(A) is a front elevational view of an insulating substrate in a semifixed variable resistor according to an embodiment of the present invention.
Figure 3B:
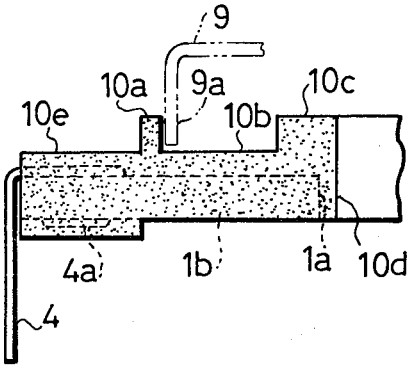
FIG. 3(B) is an enlarged cross-sectional view taken along line B—B of FIG. 3(A)
Figure 3C:
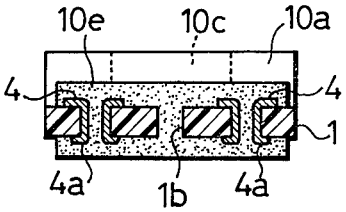
FIG. 3(C) is an enlarged cross-sectional view taken along line C—C of FIG. 3(A)
Figure 4:
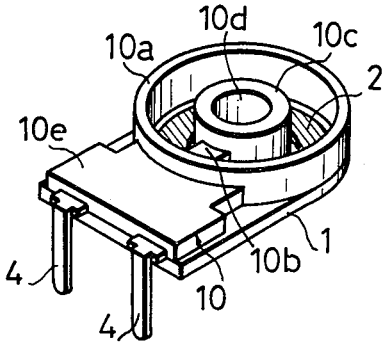
FIG. 4 is a perspective view of the insulating substrate shown in FIG. 3(A)

A molded body 10 is molded on the insulating substrate 1 by way of outsert molding, the molded body 10 being formed of a synthetic resin material different from that of the insulating substrate 1. A portion of the molded body 10 is formed as an annular dust wall 10*a* extending around the outer periphery of the resistor 2. As shown in FIG. 3(B), the dust wall 10*a* is positioned outside of and adjacent to a skirt 9*a* of a cover 9 disposed over the insulating substrate 1 and covers a gap between the skirt 9*a* and the insulating substrate 1. The molded body 10 also has a portion serving as a connector 10*b* extending radially inwardly of the dust wall 10*a* and an annular support spacer 10*c* on a distal end of the connector 10*b*. The annular support spacer 10*c* extends around the shaft hole 1*a* as shown in FIG. 3(B). The support spacer 10*c* has a central support hole 10*d* coaxial with the shaft hole 1*a*. The molded body 10 has another portion extending as a protective cover 10*e* over attachment portions 4*b* of terminals 4. As shown in FIG. 3(C), the protective cover 10*e* extends through the grommets 4*a* and the slot 1*b* to the reverse side of the insulating substrate 1. The terminal attachment end portions 4*b* are protected by the protective body 10*e* on the both surfaces of the insulating substrate 1. The end portions of the insulating substrate 1 on both sides of the slot 1*b* are retained and reinforced by the protective cover 10*e* to make up for a reduction in the mechanical strength of the insulating substrate 1 which results from the slot 1*b*.

In assembly of a semifixed variable resistor using the insulating substrate 1, a rotatable shaft similar to the rotatable shaft 5 shown in FIG. 2 is inserted into the support hole 10*d* in the support spacer 10*c*. Then, the the movable contact 6 and the cap-shaped cover 9 of insulating material are fixedly mounted on the upper portion of the shaft 5. Terminals are attached to the reverse side of the insulating substrate 1 and connected to the rotatable shaft. Since the slot 1*b* defined in the insulating substrate 1 is filled for reinforcement with a synthetic resin material, the end portions of the insulating substrate 1 on which the electrodes 3*a*, 3*b* are mounted are completely free from the danger of spreading laterally away from each other and of being damated. Accordingly, there is no need to provide grooves such as the grooves 1*c* in the opposite lateral edges of the insulating substrate as shown in FIG. 1, and to place a collector for engagement in such grooves.

In operation of the semifixed variable resistor, the cap-shaped cover 9 is rotated by fingers to rotate the rotatable shaft and the movable contact supported thereon. When the distal end of the movable contact is stopped at a desired position on the resistor 2, a resistance is established between either one of the terminals 4 and the terminal connected to the rotatable shaft. The skirt 9*a* of the cover 9 also angularly moves inside of the dust wall 10*a*, which prevents dust from entering the gap between the skirt 9*a* and the insulating substrate 1.

Figure 5A:
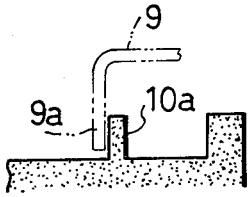
FIG. 5(A) is a fragmentary cross-sectional view of an insulating substrate according to another embodiment of the present invention.
Figure 5B:
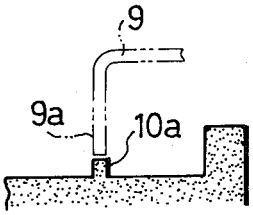
FIG. 5(B) is a fragmentary cross-sectional view of an insulating substrate according to still another embodiment of the present invention.

While in the illustrated embodiment the dust wall 10*a* is disposed outside of and closely adjacent to the skirt 9*a* of the cover 9 as shown in FIG. 3(B), the dust wall 10*a* may be positioned inside of and closely adjacent to the skirt 9*a* as shown in FIG. 5(A). Alternatively, the dust wall 10*a* may be disposed immediately below the skirt 9*a* as illustrated in FIG. 5(B).

Although in the illustrated embodiments a semifixed variable resistor has been described as being a rotary electric component by way of example, the present invention is also applicable to other electric components such as rotary switches or small-size rotary switches.

With the arrangement of the present invention, a molded body of synthetic resin is fixedly mounted on an insulating substrate and has a portion formed as a dust wall covering a gap between a cover skirt and the insulating substrate. Thus, dust or soldering flux used when connecting wires to terminals is prevented by the dust wall from entering into the cover, so that a rotary electric component incorporating such an insulating substrate is protected against malfunctions. Since the dust wall is fixedly molded on the insulating substrate by way of outsert molding, the number of parts to be assembled is not increased and so is the number of assembling steps. Outsert molding allows the dust wall to be simply fabricated in any desired shape and mass-produced. Furthermore, the dust wall permits the gap (indicated at h in FIG. 2) between the cover skirt and the insulating substrate to be widened, so that the terminal attachment end portions can be located closely to the support for the rotatable shaft, and the insulating substrate is smaller in size.

With the terminal attachment end portions covered by a portion of the molded body, the terminals are prevented from contacting terminals of other electric components or lead wires for shortcircuiting.

The synthetic resin material of the molded body filled in the slot 1*b* serves to compensate for a reduction in the mechanical strength of the insulating substrate which is caused by the slot 1*b*.

Although certain preferred embodiments have been shown and described, it should be understood that many changes and modifications may be made therein without departing from the scope of the appended claims.

What is claimed is:

1. A rotary electric component comprising:

(a) an insulating substrate having a hole adapted to receive a rotary shaft;

(b) a resistor mounted on said insulating substrate surrounding said hole;

(c) a pair of electrodes mounted on said insulating substrate and connected to said resistor at respective ends thereof;

(d) a pair of terminals mounted on said insulating substrate and connected to said electrodes, respectively;

(e) a shaft rotatably mounted in said hole and having a movable contact held in sliding contact with said resistor;

(f) a cover mounted on said shaft to lie over at least portions of said insulating substrate and said terminals, said cover covering said movable contact and having a skirt spaced from said insulating substrate by a gap to clear said terminals; and (g) means including a separate body of synthetic resin mounted on said insulating substrate and having a portion forming a dust wall covering said gap.

2. A rotary electric component according to claim 1, wherein said dust wall is located outside of and closely adjacent to said skirt of the cover.

3. A rotary electric component according to claim 1, wherein said dust wall is located inside of and closely adjacent to said skirt of the cover.

4. A rotary electric component according to claim 1, wherein said insulating substrate has a slot defined between said electrodes and serving to prevent shortcircuiting therebetween, said molded body having a portion filled in said slot.

5. A rotary electric component comprising:

(a) an insulating substrate having a hole adapted to receive a rotary shaft;

(b) a resistor mounted on said insulating substrate surrounding said hole;

(c) a pair of electrodes mounted on said insulating substrate and connected to said resistor at respective ends thereof;

(d) a pair of terminals mounted on said insulating substrate and connected to said electrodes, respectively;

(e) a shaft rotatably mounted in said hole and having a movable contact held in sliding contact with said resistor;

(f) a cover mounted on said shaft to lie over at least portions of said insulating substrate and covering said movable contact, said cover having a skirt spaced from said insulating substrate by a gap;

(g) a body of synthetic resin mounted on said insulating substrate and a portion formed as a dust wall covering said gap; and (h) wherein said terminals have terminal attachment end portions mounted on said insulating substrate, said body of synthetic resin having a portion covering said terminal attachment end portions.

6. A rotary electric component comprising:

(a) an insulating substrate having a hole adapted to receive a rotary shaft;

(b) a resistor mounted on said insulating substrate surrounding said hole;

(c) a pair of electrodes mounted on said insulating substrate and connected to said resistor at respective ends thereof;

(d) a pair of terminals mounted on said insulating substrate and connected to said electrodes, respectively;

(e) a shaft rotatably mounted in said hole and having a movable contact held in sliding contact with said resistor;

(f) a cover mounted on said shaft to lie over at least portions of said insulating substrate and covering said movable contact, said cover having a skirt spaced from said insulating substrate by a gap;

(g) a body of synthetic resin mounted on said insulating substrate and having a portion formed as a dust wall covering said gap; and (h) said insulating substrate having a slot defined between said electrodes and serving to prevent shortcircuiting therebetween, said body of synthetic resin having a portion filling in at least portions of said slot.

* * * * *